United States Patent [19]

Murrah

[11] Patent Number: 4,589,862

[45] Date of Patent: May 20, 1986

[54] APPARATUS FOR FOLDING AND TUCKING A CONTAINER CLOSURE

[75] Inventor: Howard E. Murrah, Fenton, Mich.

[73] Assignee: Ex-Cell-O Corporation, Troy, Mich.

[21] Appl. No.: 752,431

[22] Filed: Jul. 8, 1985

[51] Int. Cl.[4] ..... B31B 1/32

[52] U.S. Cl. ..... 493/183; 493/453; 53/563; 53/565

[58] Field of Search ..... 493/157, 156, 183, 184, 493/70, 80, 453; 53/374, 563, 565

[56] References Cited

U.S. PATENT DOCUMENTS 3,520,103 7/1970 Stevens ..... 493/157

4,163,414 8/1979 Bachman, Jr. et al. ..... 493/183

*Primary Examiner*—Francis S. Husar

*Assistant Examiner*—Jorji M. Griffin

*Attorney, Agent, or Firm*—John P. Moran

[57] ABSTRACT

A folding and tucking apparatus for a container end closure forming and sealing machine where a pair of oppositely rotating arms, each having a freely rotatable roller mounted on its distal end, are adapted to engage and move a heat-activated, plastic coated carton end closure panel around a score line from a vertical to a horizontal attitude. The result is that, while the rollers thus move the panel, the relative movement between the rollers and the panel is minimal, thereby preserving clean, unmarred surfaces on end panels of cartons which will be characteristically observed by consumers in the marketplace.

5 Claims, 6 Drawing Figures

APPARATUS FOR FOLDING AND TUCKING A CONTAINER CLOSURE

TECHNICAL FIELD

This invention relates generally to carton forming and sealing machines and, more particularly, to folding and tucking apparati for closing paperboard carton end closures.

BACKGROUND ART

While folding and tucking apparati have long been known and used on forming, filling and sealing machines for liquid products, such as milk and juices, heretofore such apparati have typically included oppositely pivotable arms or blades which rub along a heat-activated, plastic coated panel surface, tending to scuff or mar such printed or colored surface. Typical of such blades are those shown and described in U.S. Pat. No. 3,398,659.

DISCLOSURE OF THE INVENTION

A general object of the invention is to provide an improved folding and tucking apparatus for folding carton panels along pre-formed score lines.

Another object of the invention is to provide an improved folding and tucking apparatus wherein means are included for minimizing sliding movement between the apparatus and the panel being folded.

A further object of the invention is to provide a folding and tucking apparatus wherein freely rotatable rollers are mounted on the distal ends of oppositely positioned pivotable blades or arms, such that the rollers roll with the moving panel, thereby substantially eliminating any relative movement between the rollers and each panel engaged and folded by the rollers.

These and other objects and advantages of the invention will become more apparent when reference is made to the following description and accompanying drawings.

BEST MODE OF CARRYINIG OUT THE INVENTION

Figure 1:
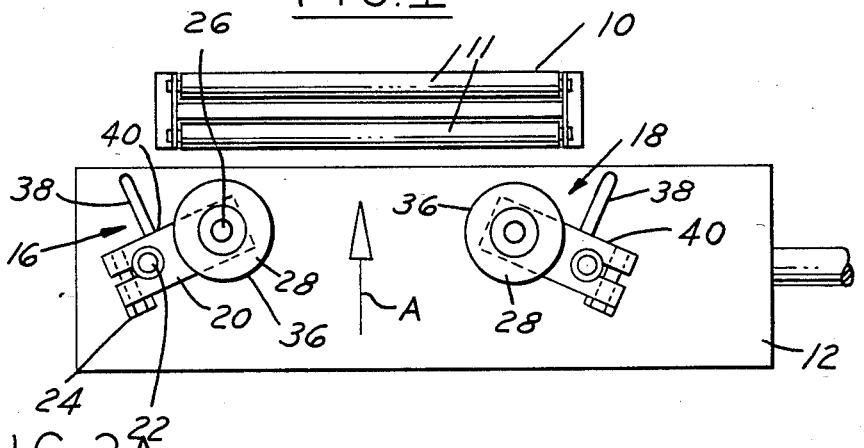
FIG. 1 is a plan view of a folding and tucking apparatus embodying the invention.

Referring now to the drawings in greater detail, FIG. 1 illustrates a fixed shoe 10, which may include a pair of adjacent rollers 11, and a drive assembly 12. The shoe 10 and drive assembly 12 are mounted on a forming, filling and sealing machine, represented at 13 in FIG. 2. An open-ended, heat-activated, four-sided, plastic coated paperboard carton 14, mounted on a mandrel 15 and having leading, trailing and two side end panels extending beyond the end of the mandrel, is caused by the mandrel to travel across the drive assembly 12 and the shoe 10 in the direction shown by the arrow A.

The drive assembly 12 includes two blade assemblies 16 and 18, each pivotally mounted thereon in oppositely disposed directions relative to one another. Each blade assembly 16 and 18 includes a body member 20 secured at one end thereof to a rotatable shaft 22 by any suitable clamping means 24.

Figure 2A:
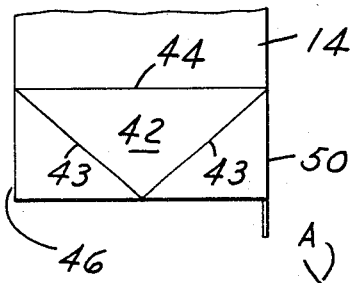
FIG. 2A is an enlarged, fragmentary side elevational view of a side end panel in its original condition prior to the operational condition illustrated in FIG. 2.
Figure 2:
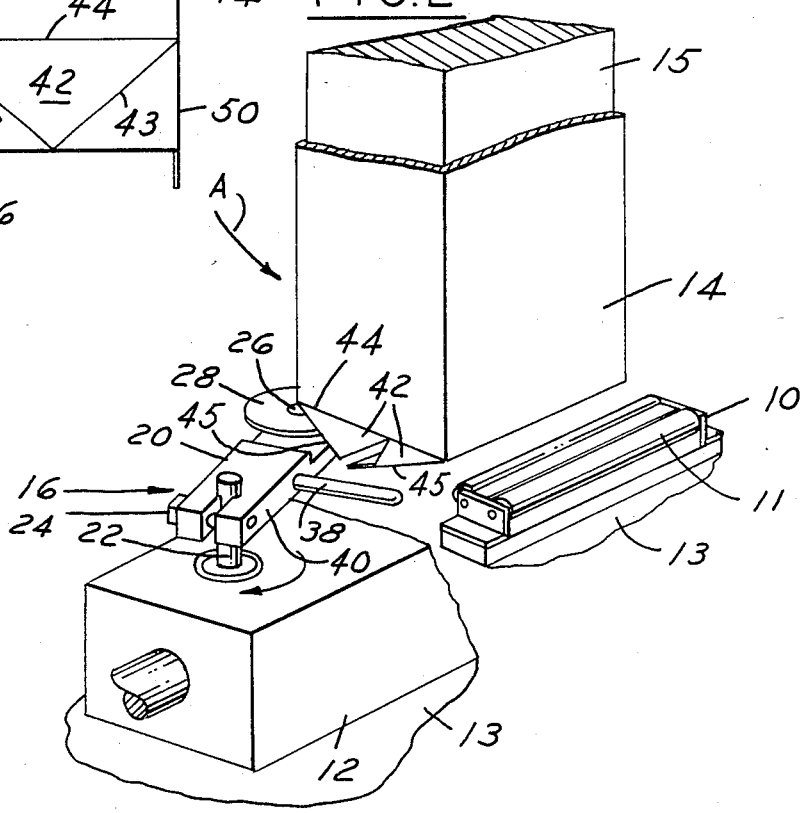
FIG. 2 is a fragmentary perspective view of the FIG. 1 apparatus and a tubular carton illustrating an operational condition of the invention.
Figure 5:
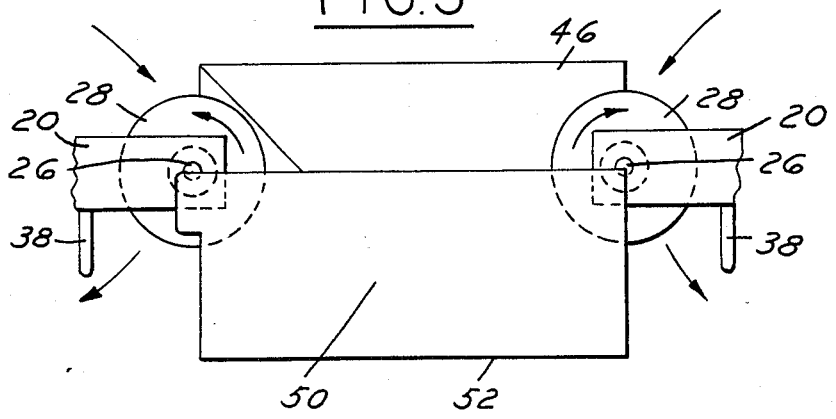
FIG. 5 is a fragmentary end view of a tubular carton illustrating a still further operational condition of the invention.
Figure 4:
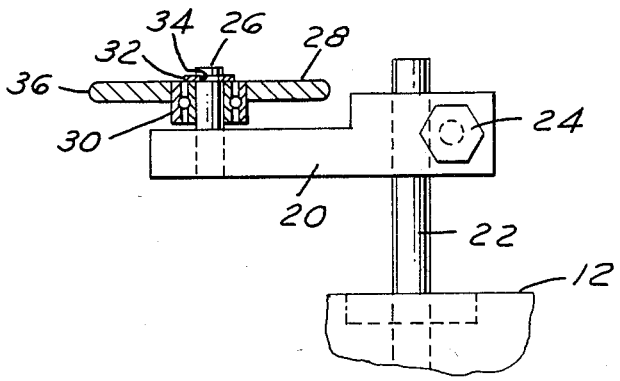
FIG. 4 is an enlarged fragmentary side elevational view of a portion of the FIG. 1 apparatus.

A vertically oriented fixed pivot pin 26 is secured to each body member 20 adjacent the distal end thereof. A disk roller or rotatable blade 28 is freely mounted on the fixed pivot pin 26 via a bearing 30 (FIG. 4), and retained thereon in any suitable manner, such as by a snap ring 32 mounted in an annular groove 34 formed in the pin 26. The disk roller 28 includes an arcuate peripheral edge 36. A pin 38 (FIGS. 1 and 2) may extend laterally from a side surface 40 of the body member 20 to serve as a pre-breaker of the respective side panels 42 bearing diagonal score lines 43 (FIG. 2A), pre-breaking the latter panels along the score lines 43 to assure that they fold inwardly with respect to the typical horizontal score lines 44 (FIG. 2) at the base of the respective side panels. Inasmuch as the four end panels are interconnected at their side edges by vertical score lines 45, pre-breaking the side panels 42 inwardly causes the leading and trailing end panels to be pulled inwardly also, somewhat as shown in FIG. 2.

In operation, the open-ended carton 14 is caused by the mandrel 15 to move in the direction of the arrow A (FIG. 1) across the drive assembly 12, toward the fixed shoe 10. As the trailing downwardly extending closure panel 46 of the carton passes over the drive assembly 12, the shafts 22 are timed to rotate in respective clockwise and counterclockwise directions, bringing the arcuate edges 36 of the disk rollers 28 into engagement with respective outer edge portions of the trailing panel 46. Since the rollers 28 are free to rotate, upon engaging the panel 46 they will rotate on the bearings 30 in response to the respective forward movements of the panel and the body member 20, while progressively lifting the panel about the typical score line 48 at the base of the trailing side panel, thereby moving with, rather than dragging across the panel surface. Thus, scuffing or marring of the typical printed and/or colored surfaces on the thus contacted carton panel is eliminated, providing an attractive appearing end closure. This is particularly important when the end closures being closed and sealed are top closures which will characteristically be on display in the marketplace.

Figure 3:
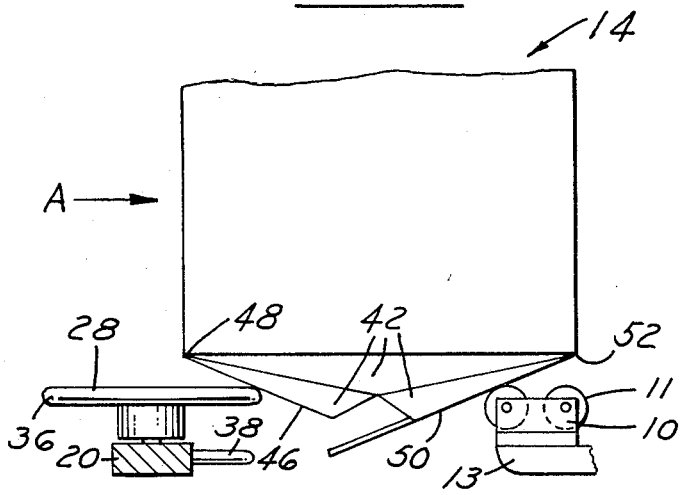
FIG. 3 is a fragmentary side elevational view of a portion of the FIG. 1 apparatus and the associated outer carton end closure panels, illustrating a further operational condition of the invention.

As the carton 14 progresses forward, its leading panel 50 will have moved into engagement with and then across the fixed shoe 10, to thereby be caused to rotate about a score line 52 at the base of the leading side panel, to end up overlapping the end panel 46 as shown in FIG. 3, but with the rollers 28 removed from therebetween.

INDUSTRIAL APPLICABILITY

It should be apparent that the invention provides improved means for folding and closing an end closure arrangement for a printed, thermoplastic coated paperboard carton by rolling, rather than dragging, the tucking and tacking members across the finished surface, thereby eliminating scuffing and marring the carton surfaces which are contacted during the closing operation.

While but one embodiment of the invention has been shown and described, other modifications thereof are possible.

The embodiments of the invention in which an exclusive property of privilige is claimed are defined as follows:

1. A tucking and folding mechanism for closing a downwardly extending trailing end panel of a vertically oriented heat-activated, plastic coated tubular paperboard carton being carried therepast, said mechanism comprising a drive assembly, a pair of oppositely rotating shafts mounted adjacent opposite ends of said drive assembly, an arm secured at one end thereof to each of said shafts for rotation therewith, a pivot pin mounted adjacent the distal end of each of said arms, and a roller freely rotatably mounted on each of said pivot pins adapted to engage said trailing end panel upon the timed rotation of said shafts to thereby rotate on said pivot pin while folding said end panel from a vertical to a horizontal position, minimizing any relative movement between said end panel and said roller to thereby prevent scuffing or marring of said panel.

2. A tucking and folding mechanism for closing vertically oriented end panels consisting of leading, trailing and opposite side panels connected by respective horizontal score lines to vertical side walls of a four-sided heat-activated, mechanism, said mechanism comprising a drive assembly, a pair of shafts operatively connected to said drive assembly so as to be oppositely rotated thereby, a pair of arms secured to said pair of shafts for rotation therewith, a pair of rollers freely rotatably mounted on the distal ends of said respective pair of arms for contacting the vertically oriented trailing end panel from behind and moving it forwardly in an arc about its respective score line to a substantially horizontal attitude, upon rotation of said pair of arms, with said rollers rotating as required to respond to the relative movements of said arms and said end panel while maintaining rolling contact with said end panel to thereby prevent scuffing or marring of said trailing panel.

3. The mechanism described in claim 2, and a pin extending from a side of each of said pair of arms for contacting the side end panels, serving to pre-break them inwardly about their respective score lines.

4. The mechanism described in claim 2, and a fixed shoe located downstream of the rotating shafts so as to be contacted by the leading end panel to cause said leading end panel to move rearwardly in an arc about its respective score line to a substantially horizontal attitude.

5. The mechanism described in claim 4, wherein said fixed shoe includes at least one roller member adapted to rotate as said leading and trailing panels traverse thereacross.

* * * * *